United States Patent [19]

Koike et al.

[11] Patent Number: 4,765,301

[45] Date of Patent: Aug. 23, 1988

[54] FUEL SUPPLY CONTROL METHOD FOR INTERNAL COMBUSTION ENGINES AFTER STARTING

[75] Inventors: Yuzuru Koike; Takafumi Nishikawa, both of Wako, Japan

[73] Assignee: Honda Giken Kogyo Kabushiki Kaisha, Tokyo, Japan

[21] Appl. No.: 12,208

[22] Filed: Feb. 6, 1987

[30] Foreign Application Priority Data

Feb. 14, 1986 [JP] Japan ..... 61-030110

[51] Int. Cl.[4] ..... F02D 41/06

[52] U.S. Cl. ..... 123/491; 123/179 L

[58] Field of Search ..... 123/179 G, 179 C, 491

[56] References Cited

U.S. PATENT DOCUMENTS

| | | | |
|---|---|---|---|
| 4,478,194 | 10/1984 | Yamato et al. | 123/491 |
| 4,522,177 | 6/1985 | Kawai et al. | 123/491 X |
| 4,582,036 | 4/1986 | Kiuchi et al. | 123/491 |
| 4,594,986 | 6/1986 | Shimoda et al. | 123/491 |

FOREIGN PATENT DOCUMENTS

| | | | |
|---|---|---|---|
| 154133 | 11/1981 | Japan | 123/491 |
| 67934 | 4/1983 | Japan | 123/491 |
| 135332 | 8/1983 | Japan | 123/491 |
| 32627 | 2/1984 | Japan | 123/491 |
| 170431 | 9/1984 | Japan | 123/491 |
| 176426 | 10/1984 | Japan | 123/491 |

*Primary Examiner*—Tony M. Argenbright

*Attorney, Agent, or Firm*—Lyon & Lyon

[57] ABSTRACT

A method of controlling the quantity of fuel supplied to an internal combustion engine after starting thereof. An initial value of a fuel increment is set in response to a temperature of the engine immediately after the start of the engine, and is subsequently decreased with the lapse of time. A quantity of fuel set by the use of the thus decreased fuel increment is supplied to the engine. The rate of decrease of the fuel increment is set to a value corresponding to a sensed temperature representative of fuel injection valves of the engine. Preferably, the rate of decrease is set to a smaller value when the sensed temperature is equal to or higher than a value corresponding to the boiling point of the fuel, than a value set when the former is lower than the latter.

7 Claims, 7 Drawing Sheets

FUEL INJECTION VALVE
6
INTERNAL COMBUSTION ENGINE
1
THREE-WAY CATALYST
13
12
11
Ne
10
Tw
9
TA
7
PBA
8
2a
2
3
3'
θTH
4
ELECTRONIC CONTROL UNIT (ECU)
5
VB SENSOR
14
OTHER SENSORS
15
STARTER SWITCH
16

START
301
TURN IGNITION SW. ON TO INITIALIZE CPU
A
302
TDC SIGNAL IS INPUTTED
I
303
INPUT, READ, & STORE BASIC ANALOG VALUES & STARTER SW. POSITION
304
CALCULATE & STORE Ne
II
305
IS ENGINE CRANKING ?
Yes
No
310
IS FUEL CUT REQUIRED ?
Yes
No
III
306
DETERMINE TiCR
307
DETERMINE KNe
308
DETERMINE TV
309
CALCULATE TOUT
B
312
CALCULATE KTW, KAST, TV, ETC.
C
313
DETERMINE Ti
314
CALCULATE TOUT
311
DO FUEL CUT
315
ACTUATE INJECTORS
END
A

| FIG. 5A | FIG. 5B |
|---|---|

FUEL SUPPLY CONTROL METHOD FOR INTERNAL COMBUSTION ENGINES AFTER STARTING

BACKGROUND OF THE INVENTION

This invention relates to a method of controlling the quantity of fuel being supplied to an internal combustion engine after the start of the engine, and more particularly to such a control method, which is adapted to set the quantity of fuel being supplied to the engine immediately after cranking thereof to appropriate values in response to the temperature of fuel injection valves.

In order to prevent engine stall after the start of the engine and obtain smooth acceleration after the engine start, a fuel supply control method has been proposed by the assignee of the present application in Japanese Provisional Patent Publication (Kokai) No. 59-46329, which comprises setting an initial value of a fuel increment which is applied immediately after the cranking of the engine, to a value corresponding to a product of a value of an engine coolant temperaturedependent fuel increasing coefficient KTW, which decreases as the engine coolant temperature representative of the engine temperature increases, and a value of an after-start fuel increasing coefficient KAST, subsequently decreasing the initial value of the fuel increment by a predetermined value upon generation of each pulse of a top-dead-center (TDC) signal, and supplying the engine with a quantity of fuel set by the use of the thus set fuel increment.

However, this conventional method, according to which the initial value of the fuel increment is set in response to the engine temperature, has a problem that, when the engine temperature at the start of the engine is so high that the fuel is boiling, it is impossible to effect optimal fuel supply during a period following the start of the engine. For example, if the engine is once stopped and started soon again, it often happens that the temperature inside the fuel injection valves is higher than the boiling point of the fuel so that bubbles are apt to be formed in the fuel within the fuel injection valves. As a result, the fuel injected into the intake pipe of the engine contains these bubbles so that the air-fuel mixture supplied to the engine is in effect leaned, whereby engine stall is apt to occur and it becomes difficult to obtain smooth acceleration of the engine after the start thereof.

SUMMARY OF THE INVENTION

It is the object of the invention to provide a fuel supply control method for internal combustion engines after the start of the engines, which is capable of ensuring stable operation of the engine after the start of the engine even when the fuel is boiling.

According to the present invention, there is provided a method of controlling the quantity of fuel being supplied to an internal combustion engine having fuel injection valves after starting thereof, which is adapted to set an initial value of a fuel increment in response to a temperature of the engine immediately after the start of the engine, subsequently decrease the fuel increment from the set initial value thereof with the lapse of time, and supply the engine with a quantity of fuel set by the use of the thus decreased fuel increment. The method comprises the steps of: (a) sensing intake air temperature in the vicinity of the fuel injection valves; and (b) setting a rate at which the fuel increment is decreased, to a value corresponding to the sensed intake air temperature.

Preferably, the temperature representative of the temperature of the fuel injection valves is sensed immediately after the start of the engine.

Preferably, when the sensed temperature representative of the temperature of the fuel injection valves is higher than a predetermined value corresponding to the boiling point of fuel, the rate of decrease of the fuel increment is set to a smaller value than that to which it is set when the sensed temperature is lower than the predetermined value.

More preferably, the initial value of the fuel increment is set upon generation of a predetermined control signal representative of predetermined crank angles of the engine immediately after cranking of the engine, the set initial value of the fuel increment being subsequently decreased by a predetermined amount each time a first predetermined number of pulses of the control signal are generated when the sensed temperature representative of the temperature of the fuel injection valves is lower than the predetermined value corresponding to the boiling point of the fuel, and while the set initial value of the fuel increment being subsequently decreased by the predetermined amount each time a second predetermined number of pulses of the control signal are generated when the sensed temperature is equal to or higher than the predetermined value, the second predetermined number being greater than the first predetermined number.

The above and other aspects, features and advantages of the invention will be more apparent from the ensuing detailed description taken in conjunction with the accompanying drawings.

DETAILED DESCRIPTION

An embodiment of the invention will now be described in detail with reference to the drawings.

Figure 1:
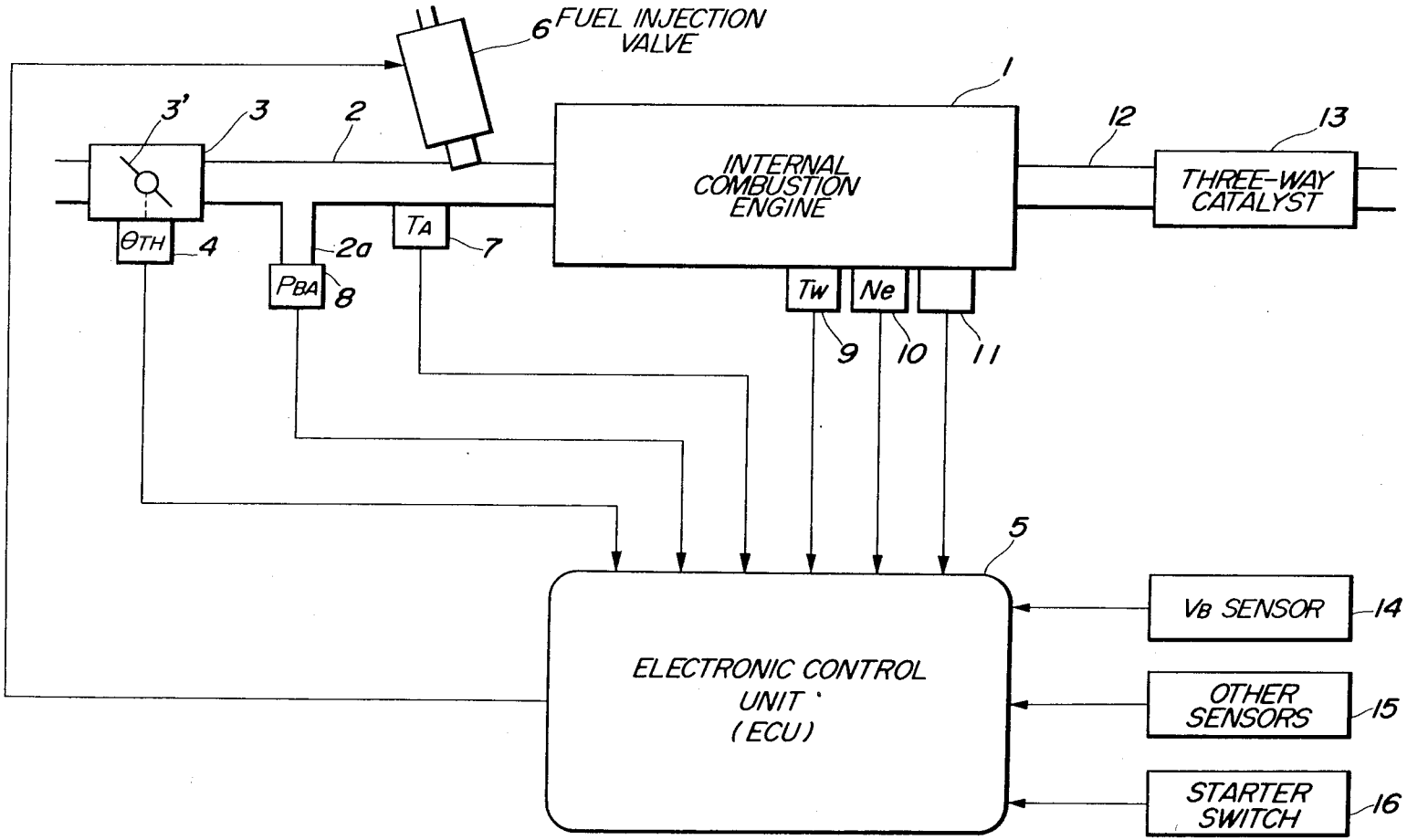
FIG. 1 is a block diagram illustrating the whole arrangement of a fuel supply control system of an internal combustion engine to which is applied the method according to the invention.

Referring first to FIG. 1, there is illustrated the whole arrangement of a fuel supply control system of an internal combustion engine to which is applied the method according to the invention. In the figure, reference numeral 1 designates an internal combustion engine which may be a four-cylinder type for instance, and to which is connected an intake pipe 2. A throttle body 3 is arranged across the intake pipe 2, and accommodates a throttle valve 3'. A throttle valve opening ($\theta$th) sensor 4 is connected to the throttle valve 3' for sensing its valve opening an is electrically connected to an electronic control unit (hereinafter called "the ECU") 5, to supply same with an electrical signal indicative of the throttle valve opening sensed thereby.

Fuel injection valves 6 are arranged in the intake pipe 2 each at a location slightly upstream of an intake valve, not shown, of a corresponding one of the engine cylinders, not shown, and between the engine 1 and the throttle body 3, for supplying fuel to the corresponding engine cylinder. The fuel injection valves 6 are connected to a fuel pump, not shown, and are electrically connected to the ECU 5, in a manner having their valve opening periods or fuel injection quantities controlled by signals supplied from the ECU 5.

An intake air temperature (TA) sensor 7 is arranged in the intake pipe 2 at a location slightly upstream of the fuel injection valves 6, to sense intake air temperature (TA), and converts the sensed intake air temperature (TA) into an electrical signal applied to the ECU 5.

On the other hand, an absolute pressure (PBA) sensor 8 communicates through a conduit 2*a* with the interior of the intake pipe 2 at a location downstream of the throttle valve 3' of the throttle body 3, to sense absolute pressure in the intake pipe 2 and applies an electrical signal indicative of detected absolute pressure to the ECU 5.

An engine coolant temperature (TW) sensor 9, which may be formed of a thermistor or the like, is mounted on the cylinder block of the engine 1 in a manner embedded in the peripheral wall of an engine cylinder having its interior filled with coolant, of which an electrical output signal indicative of the sensed coolant temperature is supplied to the ECU 5.

An engine speed (Ne) sensor 10 and a cylinder-discriminating (CYL) sensor 11 are arranged on a camshaft, not shown, of the engine 1 or a crankshaft of same, not shown. The former sensor 10 is adapted to generate one pulse at one of four predetermined crank angles each time the engine crankshaft rotates through 180 degrees, i.e. one pulse of the top-dead-center position (TDC) signal, while the latter is adapted to generate one pulse at a particular crank angle of a particular engine cylinder. The above pulses generated by the sensors 10, 11 are supplied to the ECU 5.

A three-way catalyst 13 is arranged in an exhaust pipe 12 extending from the cylinder block of the engine 1 for purifying ingredients HC, CO and NOx contained in the exhaust gases.

Further connected to the ECU 5 are a VB sensor 14 for sensing battery voltage and other parameter sensor 15 such as one for sensing atmospheric pressure (PA), and also an engine starter switch 16, for suppling the ECU 5 with signals indicative of the values sensed by the VB sensor and other parameter sensor 15 and an on-off state signal from the starter switch 16.

The ECU 5 operates to calculate the valve opening period TOUT of the fuel injection valves 6 in a manner hereinafter described in detail, and supplies driving signal corresponding to the calculated TOUT value to the fuel injection valves 6 to open same.

Figure 2:
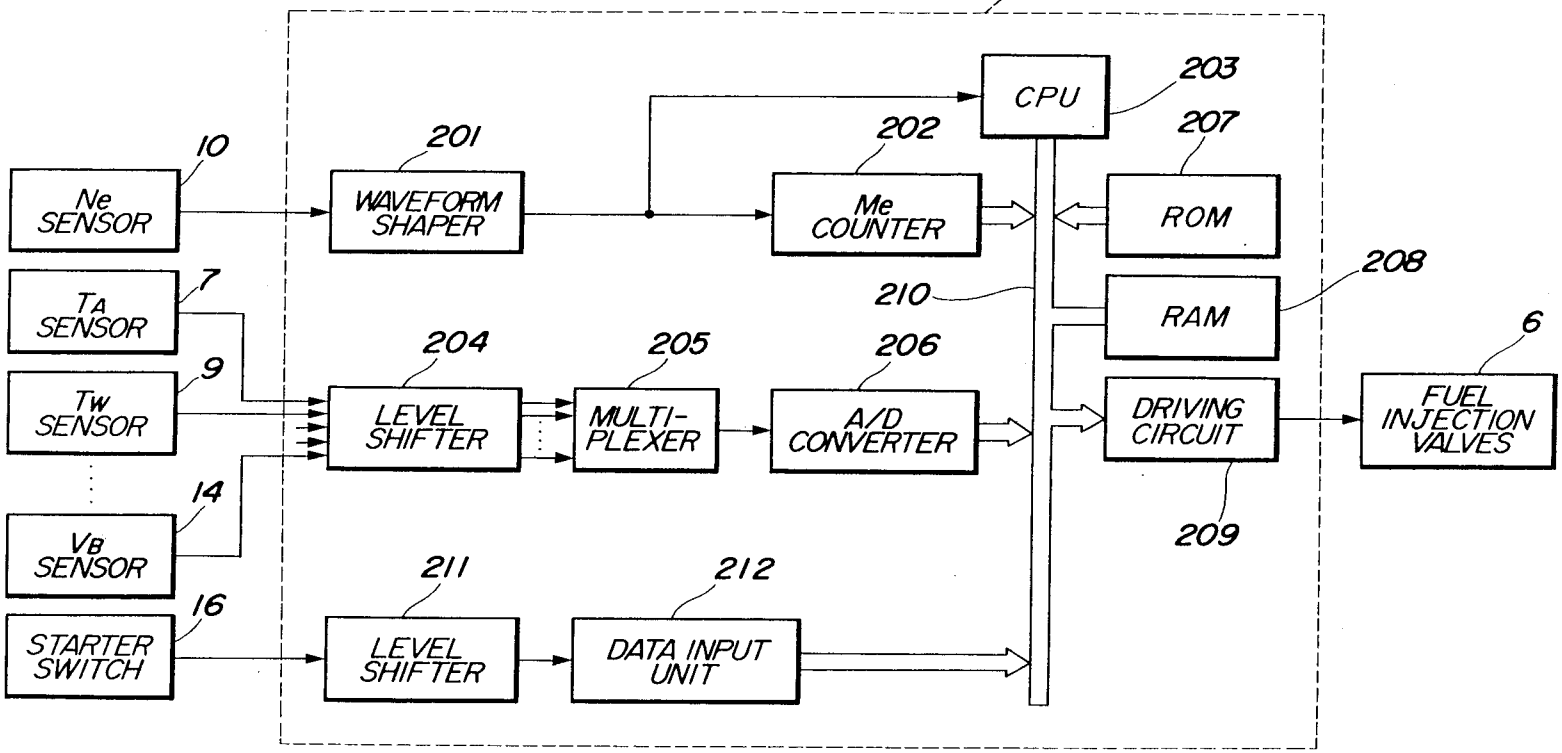
FIG. 2 is a block diagram illustrating the interior arrangement of an electronic control unit (ECU) 5 appearing in FIG. 1.

FIG. 2 shows a circuit configuration within the ECU 5 in FIG. 1. An output signal from the Ne sensor 10 in FIG. 1 indicative of the rotational speed of the engine is applied to a waveform shaper 201, wherein it has its pulse waveform shaped, and supplied to a central processing unit (hereinafter called the "CPU") 203, as well as to an Me value counter 202, as the TDC signal. The Me value counter 202 counts the interval of time between a preceding pulse of the TDC signal and a present pulse of the same signal, inputted thereto from the Ne sensor 10. Therefore, its counted value Me corresponds to the reciprocal of the actual engine rotational speed Ne. The Me value counter 202 supplies the counted value Me to the CPU 203 via a data bus 210.

The respective output signals from the intake air temperature (TA) sensor 7, the engine coolant temperature (TW) sensor 9, the VB sensor 14, all appearing in FIG. 1, and other sensors have their voltage levels shifted to a predetermined voltage level by a level shifter 204 and successively applied to an analog-to-digital converter 206 through a multiplexer 205. The analog-to-digital converter 206 successively converts into digital signals analog output voltages from the aforementioned various sensors, and the resulting digital signals are supplied to the CPU 203 via the data bus 210.

The on-off state signal from the starter switch 16 in FIG. 1 has its voltage level shifted to a predetermined voltage level by a level shifter 211 and, after being converted into a predetermined signal in a data input unit 212, is supplied to the CPU 203 via the data bus 210.

Further connected to the CPU 203 via the data bus 210 are a read-only memory (hereinafter called "the ROM") 207, a random access memory (hereinafter called "the RAM") 208 and a driving circuit 209. The RAM 208 temporarily stores various calculated values from the CPU 203, while the ROM 207 stores a control program to be executed within the CPU 203 as well as a table of values of the engine coolant temperature-dependent fuel increasing coefficient KTW and a table of values of the engine coolant temperature-dependent coefficient CAST, both of which are subjected to selective reading of their values in manners as hereinafter described, etc. The CPU 203 executes the control program stored in the ROM 207 to calculate the fuel injection period TOUT for the fuel injection valves 6 in response to the various engine operation parameter signals, and supplies the calculated period value to the driving circuit 209 through the data bus 210. The driving circuit 209 supplies driving signals corresponding to the above calculated TOUT value to the fuel injection valves 6 to drive same.

Next, the operation of the fuel supply control system arranged as above will now be described with reference to FIGS. 1 and 2 referred to hereinabove and FIGS. 3 through 8.

Figure 3:
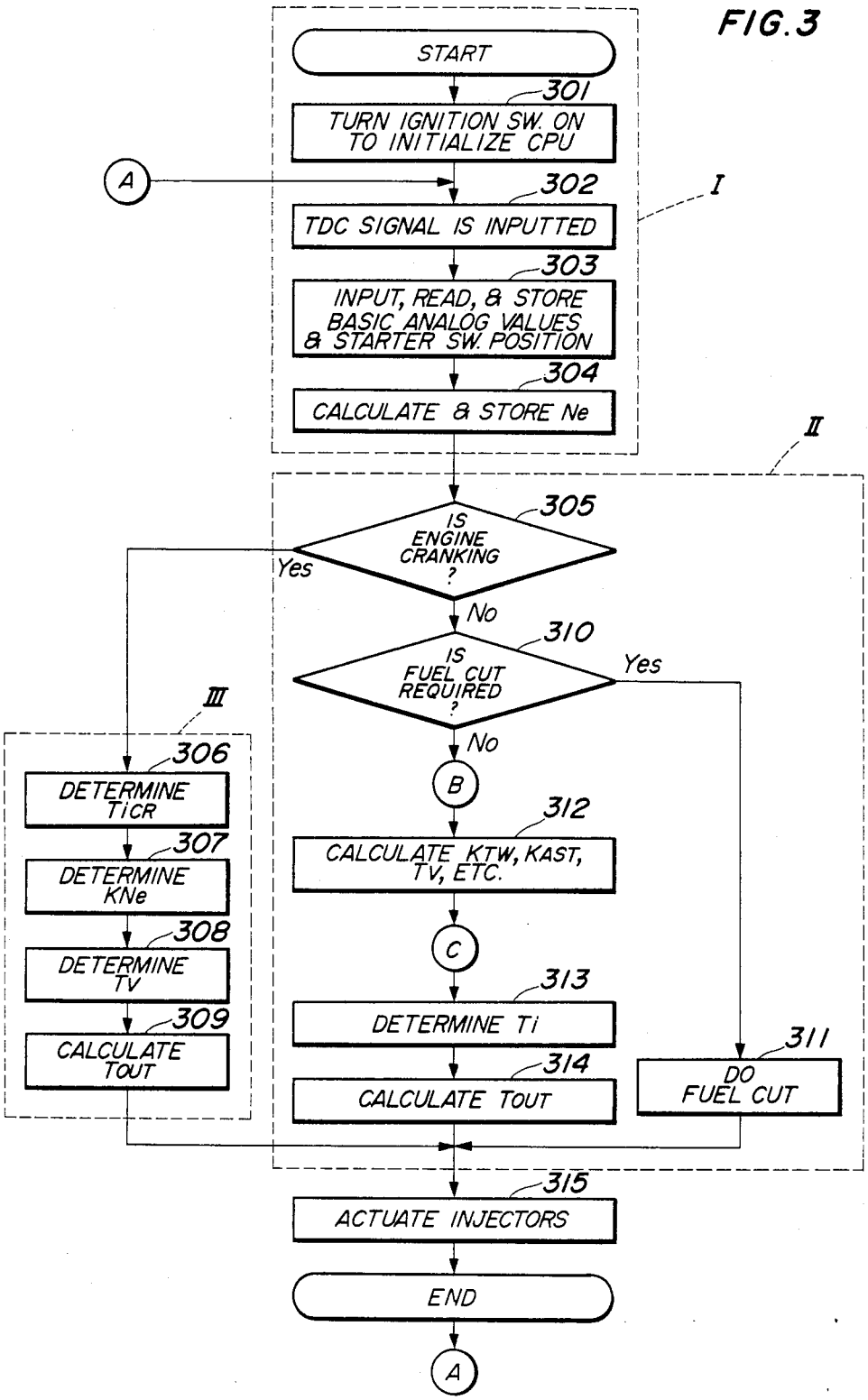
FIG. 3 is a flow chart showing a procedure of obtaining the valve opening period TOUT of fuel injection valves.

Referring to FIG. 3, there is shown a flow chart of the aforementioned fuel supply control program 1 for control of the valve opening period, which is executed by the CPU 203 in FIG. 2 in synchronism with generation of the TDC signal. The whole program comprises an input signal processing block I, a basic control block II and a start control block III. First in the input signal processing block I, when the ignition switch of the engine is turned on, the CPU 203 is initialized at step 301 and the TDC signal is inputted to the ECU 5 as the engine starts at step 302. Then, all basic analog values are inputted to the ECU 5, which include sensed values of intake air temperature TA, intake pipe absolute pressure PBA, engine coolant temperature TW, battery voltage VB, throttle valve opening θth, and on-off state signal of the starter switch 16, some necessary ones of which are then stored in the ECU 5 (step 303). Further, the period between a pulse of the TDC signal and the next pulse of same is counted to calculate the actual engine rotational speed Ne on the basis of the counted value, and the calculated value is stored in the ECU 5 (step 304).

The program then proceeds to the basic control block II. In this block, a determination is made, in a manner hereinafter described in detail, as to whether or not the engine is in a cranking state, at step 305. If the answer is affirmative, the program proceeds to the start control subroutine III. In this block, a TiCR value, which is a basic value of the valve opening period for the fuel injection valves 6 at the start of the engine, is selected from the TiCR table, on the basis of the sensed value of engine coolant temperature TW (step 306). Also, the value of Ne-dependent correction coefficient KNe is determined by using the KNe table (step 307). Further, the value of battery voltage-dependent correction value TV is determined by using the TV table (step 308). These determined values are substituted into the following equation (1) to calculate the value of TOUT (step 309):

$$TOUT = TiCR \times KNe + TV \quad (1).$$

If the answer to the question of the above step 305 is No, it is determined whether or not the engine is in a condition for carrying out fuel cut, at step 310. If the answer is Yes, the value of TOUT is set to zero, at step 311.

On the other hand, if the answer to the question of step 310 is negative, calculations are carried out of values of correction coefficients KTW, KAST, etc. and correction variables TV, etc. for correcting the basic valve opening period Ti of the fuel injection valves at step 312. KTW is an engine coolant temperature-dependent fuel increasing coefficient which is determined from a table like the one shown in FIG. 7 as a function of actual engine coolant temperature TW, KAST a fuel increasing coefficient, as an after-start fuel increment, applicable after the start of the engine and determined by a subroutine of FIG. 5 to be described later, and TV a battery voltage-dependent correction value determined by using a table, not shown.

Then, a value of the basic valve opening period value Ti is determined from a Ti value map, which is selected in response to data of actual engine rotational speed Ne and actual absolute pressure PBA and/or like parameters, at step 313. Then, at step 314 a calculation is carried out to obtain the valve opening period TOUT by correcting the basic valve opening period value Ti with the values of correction coefficients and correction values determined and selected at the steps 312 and 313, as described above, using the following equation (2):

$$TOUT = Ti \times KTW \times KAST \times K1 + K2 + TV \quad (2)$$

where K1 and K2 represent correction coefficients and correction variables having their values calculated by respective predetermined equations on the basis of the values of engine parameter signals from various sensors such as throttle valve opening (θth) sensor 4, the absolute pressure (PBA) sensor 8, the engine rotational speed (Ne) sensor 10, the cylinder-discriminating (CYL) sensor 11, other parameter sensors 15 and the starter switch 16 so as to optimize operating characteristics of the engine such as emission characteristics, fuel consumption, and engine accelerability. The fuel injection valves 6 are operated based on the value of TOUT thus determined (step 315).

Next, a subroutine for determining whether or not the engine is in a cranking state, and a subroutine for calculating the value of the after-start fuel increasing coefficient KAST, as part of the control of the valve opening period described hereinabove will not be described.

Figure 4:
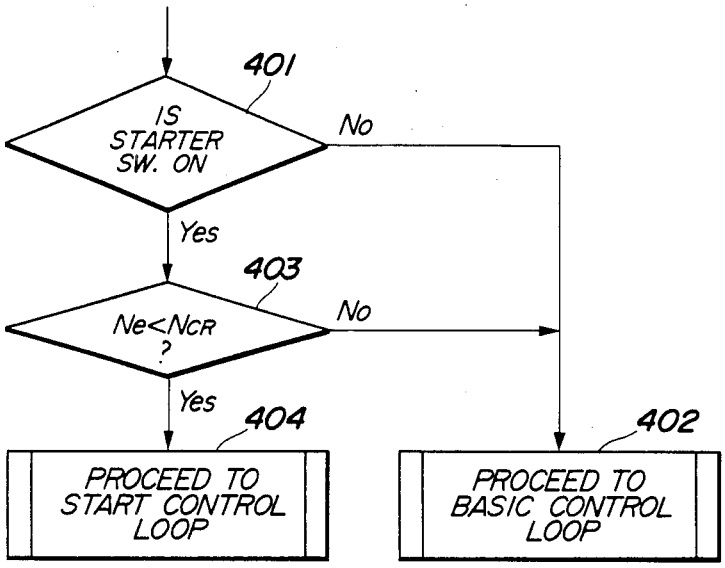
FIG. 4 is a flow chart showing a subroutine forming part of the flow chart of FIG. 3, for determining a cranking state of the engine.

FIG. 4 shows a flow chart of the subroutine for executing step 305 in FIG. 3 for determining whether or not the engine is in a cranking state. It is first determined at step 401 whether or not the starter switch 16 is closed. If the starter switch 16 is not closed, it is assumed that the engine is not cranking, and the program proceeds to step 402, i.e. the basic control loop (block II in FIG. 3), while if the starter switch 16 is closed, a determination is made as to whether or not the engine rotational speed Ne is lower than a predetermined cranking speed NCR (e.g. 400 rpm) at step 403, and if the former is higher than the latter, the program proceeds to the abovementioned basic control loop under the assumption that the engine is not cranking (step 402), whereas if the former is lower than the latter, the program proceeds to step 404, i.e. the start control loop (block III in FIG. 3) under the assumption that the engine is cranking.

Figure 5A:
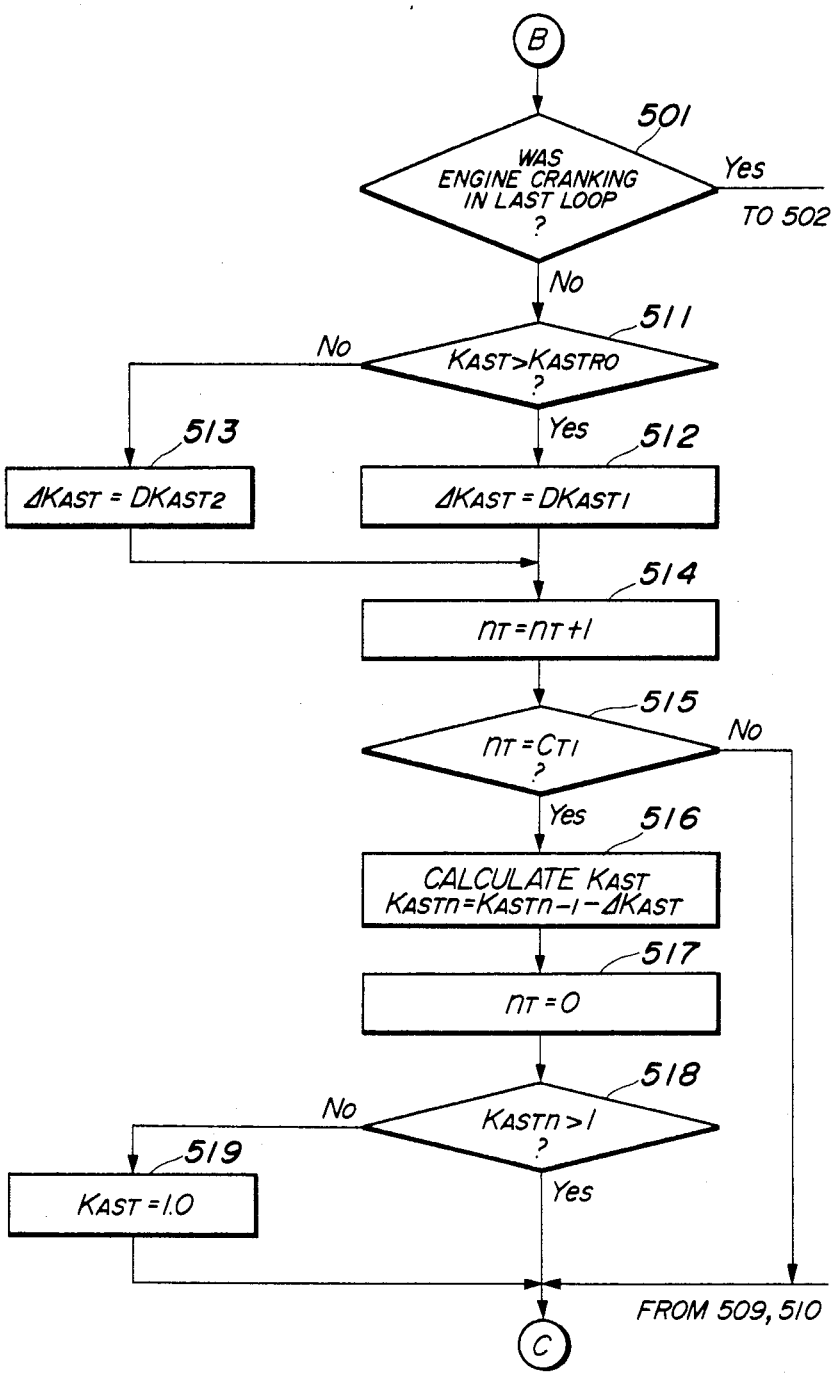
FIG. 5 is a flow chart showing a manner of calculation the value of an after-start fuel increasing coefficient KAST.
Figures 5, 5B:
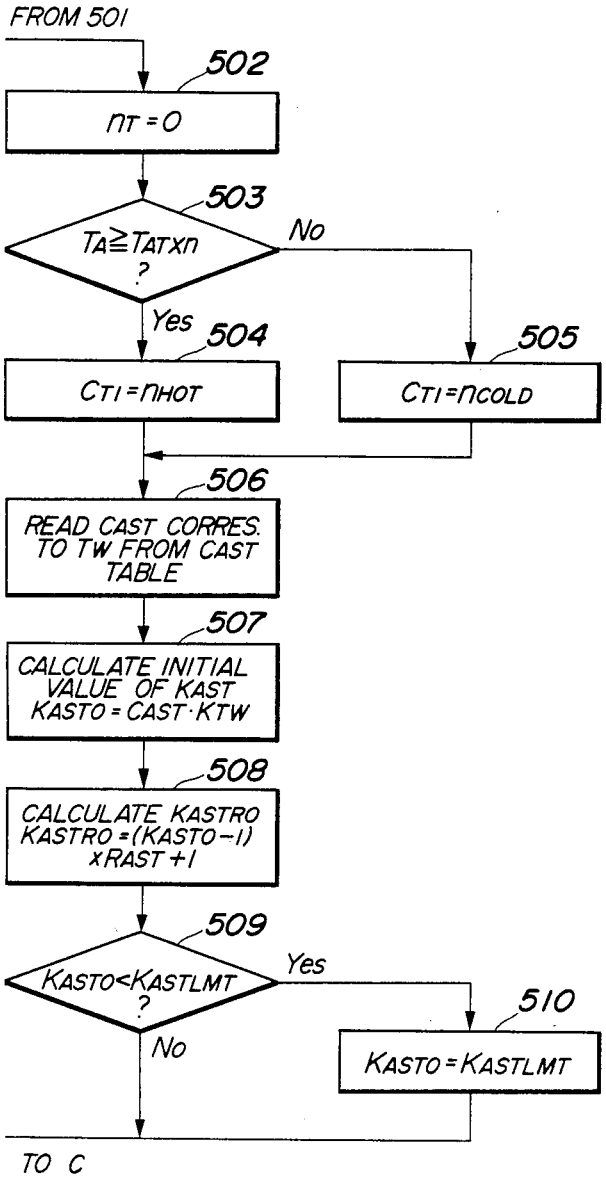

FIG. 5 shows a flow chart of the subroutine for calculating the value of the after-start fuel increasing coefficient KAST according to the method of the invention which is executed each time a pulse of the TDC signal is generated. First, it is determined at step 501 whether or not the engine was in a cranking state in the last loop of execution of the subroutine. If the engine was cranking, a control variable nT is set to zero (step 502). This control variable nT is indicative of the number of TDC signal pulses generated after the engine has completed cranking, over which the decreasing of the after-start fuel increasing coefficient KAST, as explained later, is withheld.

The program then proceeds to step 503 to determine whether or not the intake air temperature TA is higher than a predetermined value TATXN (e.g. 100° C.). This intake air temperature TA is sensed and stored at the time of generation of a TDC signal pulse generated upon completion of the engine cranking. The step 503 is provided for the following reason: As described above, if the temperature in the fuel injection valves 6 exceeds the boiling point of the fuel, the fuel inside the fuel injection valves boils to produce bubbles therein, whereby the mixture supplied to the engine is leaned in effect. Therefore, when the temperature inside the fuel injection valves 6 is higher than the boiling point of the fuel, it is desirable that the after-start fuel increment should be made larger than it is when the temperature inside the fuel injection valves 6 is lower than the boiling point of the fuel. The temperature inside the fuel injection valves 6 can be estimated from the intake air temperature TA sensed by the intake air temperature sensor 7, because the intake air temperature sensor 7 is installed in the intake pipe 2 at a location slightly upstream of the fuel injection valves 6 so that the intake air temperature TA sensed by the intake air temperature sensor 7 is approximate to the temperature inside the fuel injection valves 6. Therefore, according to the invention, by comparing the intake air temperature TA with the predetermined value TATXN, which corresponds to the boiling point of the fuel, at step 503, it is determined whether the fuel in the fuel injection valves 6 is boiling. Based on this determination, the rate at which the after-start fuel increment is decreased is controlled in a manner described later, that is, when TA≧TATXN, the rate of decrease of the after-start fuel increasing increment is decreased, and when TA<TATXN, the rate of decrease of the after-start fuel increasing increment is increased.

Next, a predeterminable number CT1 with which the control variable nT is compared is set in response to the intake air temperature TA representative of the temperature of the fuel injection valves (step 504 or step 505). As described later, when the control variable nT reaches this number CT1, that is, each time as many TDC signal pulses as the number CT1 are generated after the engine was completed cranking, decreasing of the after-start fuel increasing coefficient KAST is commenced. If the answer to the question of the step 503 is Yes, that is, if TA≧TATXN, the number CT1 is set to a predetermined value nHOT (e.g. 5) applied when the fuel is boiling, at step 504. If the answer to the question of the step 503 is No, that is, if TA<TATXN, the number CT1 is set to a predetermined value nCOLD (e.g. 1) applied when the fuel is not boiling at step 505.

Figure 6:
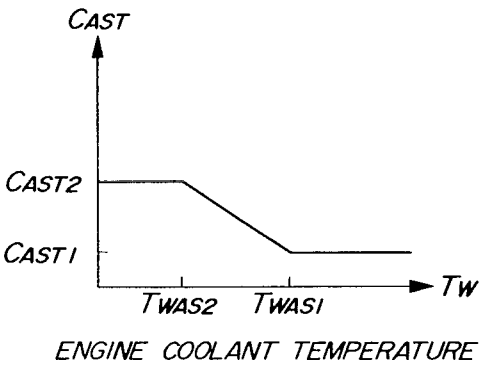
FIG. 6 is a graph showing a table of the relationship between the engine coolant temperature TW and a coolant temperature-dependent fuel increasing coefficient CAST applied for calculation of the value of the after-start fuel increasing coefficient KAST.

After the number CT1 has thus been set, the program then proceeds to step 506 wherein a value of the engine coolant temperature-dependent coefficient CAST, which is used for calculation of an initial value of the after-start fuel increasing coefficient KAST, is read from the CAST table stored in the ROM 207 in response to the engine coolant temperature TW. The coolant temperature TW is sensed at the time of generation of a TDC signal pulse generated upon completion of the engine cranking. Shown in FIG. 6 is an example of the CAST table. According to the table, when the engine coolant temperature TW is lower than a predetermined value TWAS2 (e.g. −10° C.), a value CAST 2 (e.g. 1.1) is selected as the value of the coefficient CAST, while when the engine coolant temperature TW is higher than a predetermined value TWAS1 (e.g. +10° C.), a value CAST 1 (e.g. 1.0) is selected. When the engine coolant temperature TW is between TWAS2 and TWAS1, the coefficient CAST is calculated by interpolation. Incidentally, the CAST value may be set to different values with respect to the engine coolant temperature TW depending on whether or not the atmospheric pressure PA is higher than a predetermined value and/or whether the vehicle in which the engine is installed is equipped with a manual transmission (MT) or an automatic transmission (AT), to thereby obtain a more appropriate value of the coolant temperature-dependent coefficient CAST. To this end, a plurality of, e.g. 4, CAST tables may be provided, from which one table is selected in response to fulfilment of any of the above conditions. Furthermore, engine characteristics may be taken into consideration in setting of the CAST tables.

Referring again to FIG. 5, the initial value of the after-start fuel increasing coefficient KAST is calculated on the basis of the value of the coolant temperature-dependent coefficient CAST read at the step 506, by the use of the following equation (3), at step 507:

$$KASTO = CAST \times KTW \quad (3)$$

where KTW represents the coolant temperature-dependent fuel increasing coefficient, referred to hereinbefore, the value of which is determined from a table as a function of the engine coolant temperature TW.

Figure 7:
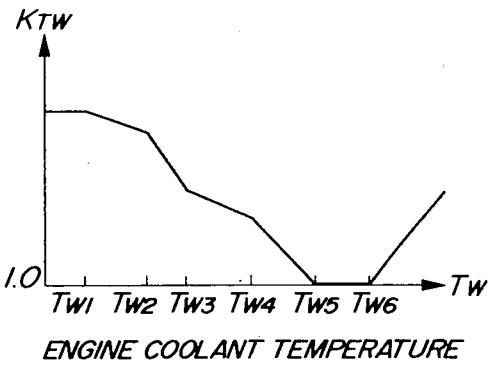
FIG. 7 is a graph showing a table of the relationship between a coolant temperature-dependent fuel increasing coefficient KTW and the engine coolant temperature TW.

FIG. 7 shows an example of a table of values of the fuel increasing coefficient KTW set in relation to the engine coolant temperature TW. According to the table, when the engine coolant temperature TW is between predetermined values TW5 (e.g. 60° C.) and TW6 (e.g. 100° C.), the value of the coefficient KTW is held at 1.0, whereas when the temperature TW is equal to or lower than the predetermined value TW5, five predetermined values of the coefficient KTW are selected as the coolant temperature TW assumes respective five predetermined values TW1–TW5. If the engine coolant temperature TW assumes a value intervening between adjacent ones of the predetermined values, the value of the coefficient KTW is determined by means of an interpolation method. If the engine coolant temperature TW is higher than the predetermined value TW6, the coefficient KTW is set to values greater than 1.0 such that the higher the coolant temperature TW the greater the coefficient KTW, because it is desirable to set the initial value KASTO of the after-start fuel increasing coefficient KAST to a larger value when the fuel inside the fuel injection valves 6 is boiling, so as to prevent leaning of the mixture caused by boiling of the fuel.

Referring again to FIG. 5, the program then proceeds to the step 508, wherein a reference value KASTRO of the after-start fuel increasing coefficient KAST is calculated. The reference value KASTRO is provided to decrease the value of the after-start fuel increasing coefficient KAST at a larger rate until the value of the coefficient KAST becomes equal to the reference value KASTRO, and to decrease the value of the after-start fuel increasing coefficient KAST at a smaller rate after the value of the coefficient has become smaller than the reference value KASTRO, as hereinbelow described, whereby the value of the after-start fuel increasing coefficient KAST conforms more exactly to the fuel increasing demanded by the engine immediately after its start. Details of this method are disclosed by U.S. Pat. No. 4,582,036 granted to the assignee of the present application. The reference value KASTRO is calculated by the use of the following equation (4):

$$KASTRO = (KASTO - 1) \times RASTO + 1 \quad (4)$$

where KASTO represents the initial value of the after-start fuel increasing coefficient KAST calculated at the foregoing step 507, and RASTO is predetermined coefficient (e.g. 0.5) which is set at such a value as to obtain a desired quantity of fuel supplied to the engine during the after-start fuel increasing period corresponding to the engine temperature.

Then it is determined whether or not the initial value KASTO of the coefficient KAST calculated at the step 507 is smaller than a predetermined lower limit value KASTLMT (e.g. 1.05) at step 508. If the answer to the question of the step 509 is Yes, that is, if KASTO is smaller than KASTLMT, the initial value KASTO is set to the value of KASTLMT at step 510, and if the answer to the question of the step 509 is No, the initial value KASTO calculated at the step 507 is applied as it is. The program proceeds through the steps 502–510 only once immediately after the engine has completed cranking to thereby determine the initial value KASTO of the after-start fuel increasing coefficient KAST in response to the engine coolant temperature TW and the reference value KASTRO based upon the initial value KASTO, and then proceeds to the step 313 in FIG. 2.

When the answer to the question of step 501 is No, that is, if the engine was not cranking in the immediately preceding loop, the program proceeds to step 511 to determine whether or not the value of the after-start fuel increasing coefficient KAST set in the immediately preceding loop is larger than the reference value KASTRO calculated at the step 508. If the answer to the question of the step 511 is affirmative, a subtracting constant ΔKAST is set to a predetermined value DKAST1 at step 512, while if the answer to the question of the step 511 is negative, the subtracting constant ΔKAST is set to another predetermined value DKAST2 which is smaller than the predetermined value DKAST1, at step 513.

Next, the program proceeds to step 514 to add 1 to the control variable nT, and then at step 515 it is determined whether or not the control variable nT renewed at the step 514 is equal to the number CT1 set at the step 504 or the step 505. If the answer to the question at the step 515 is No, that is, if the control variable nT has not reached the predetermined number CT1, the program proceeds to the step 313. If the answer to the question at the step 515 is Yes, that is, if the control variable nT has reached the predetermined number CT1, then the program proceeds to step 516, wherein the value of the fuel increasing coefficient KASTn is set to a value obtained by decreasing the value KASTn−1 set in the immediately preceding loop by the subtracting constant ΔKAST. Then the program proceeds to step 517 to reset the control varaible nT to 0.At the next step 518 it is determined whether or not the value of KASTn set at the step 516 is greater than 1.0. If the answer is Yes, the program proceeds to the step 313.

Figure 8:
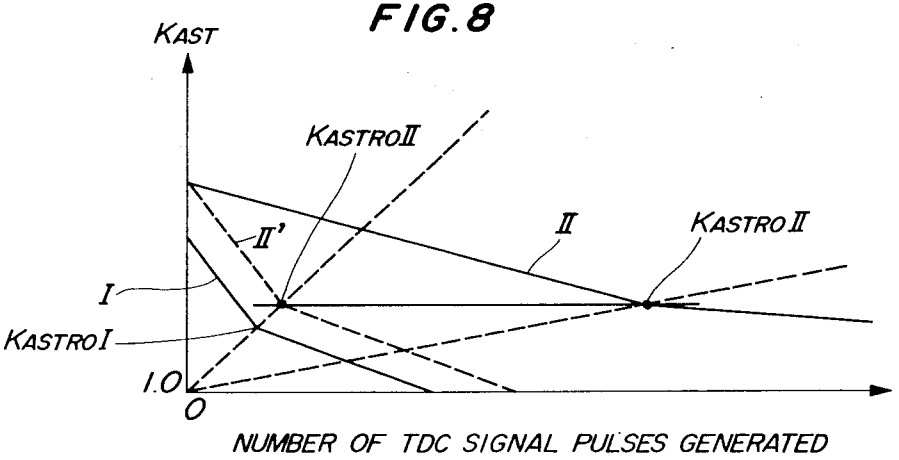
FIG. 8 is a graph showing how the value of the after-start fuel increasing coefficient KAST changes, which is calculated in the manner shown in FIG. 5, as pulses of the TDC signal are generated.

The program of FIG. 5 is repeated each time a TDC signal pulse is generated, so that the after-start fuel increasing coefficient KAST is decreased along the solid bent lines I, II, etc. in FIG. 8, which are selected in response to the intake air temperature, the engine coolant temperature, etc. sensed immediately after the cranking of the engine.

More specifically, as described above, when the intake air temperature TA is smaller than the predetermined value TATXN, that is, when the fuel in the fuel injection valves is not boiling, the number CT1 is set to the smaller predetermined value nCOLD at the step 505 in FIG. 5. If nCOLD is set at 1, for example, the decreasing of the after-start fuel increasing coefficient KAST at step 516 is carried out every time the program is executed upon generation of a TDC signal pulse, so that the after-start fuel increasing coefficient KAST decreases along the solid line I in FIG. 8 to thereby bring about ordinary after-start fuel increasing.

On the other hand, when the intake air temperature TA is higher than the predetermined TATXN, that is, when the fuel in the fuel injection values 6 is boiling, the number CT1 is set to the larger predetermined value nHOT at the step 504 in FIG. 5. If nHOT is set at 5, for example, the decreasing of the after-start fuel increasing coefficient KAST at the step 516 is carried out each time the control variable nT reaches the number CT1 (=nHOT) at the step 505, i.e. at every fifth TDC signal pulse so that the after-start fuel increasing coefficient KAST decreases along the solid line II in FIG. 8. Therefore, supposing that the engine coolant temperature is the same, the rate of decrease of the after-start fuel increasing coefficient KAST becomes smaller than that obtained by the conventional method as indicated by the broken line II' in FIG. 8 (the former is five times as small as the latter in the embodiment).

Thus, when the fuel in the fuel injection valves 6 is boiling, it is possible to prevent leaning of the mixture to thereby secure stable driveability of the engine by setting the rate of decrease of the fuel increasing coefficient KAST to a lower value.

Incidentally, in the example of FIG. 8 the bent lines I, and II and II' are plotted based upon different values of the engine coolant temperature TW sensed upon completion of the engine cranking, with their respective initial values KASTO of the coefficient KAST set to different values from each other.

When the fuel increasing coefficient KAST has been decreased to 1.0 or less through repeated execution of the program, the answer to the question of the step 518 becomes No, whereupon it is regarded that the after-start fuel increasing period has elapsed, and the program terminates after setting the fuel increasing coefficient KAST to 1.0 (step 519).

What is clamed is:

1. A method of controlling the quantity of fuel being supplied to an internal combustion engine having fuel injection valves after starting thereof, which is adapted to set an initial value of a fuel increment in response to a temperature of said engine immediately after the start of said engine, subsequently decrease said fuel increment from the set initial value thereof with the lapse of time, supply said engine with a quantity of fuel set by the use of the thus decreased fuel increment, the method comprising the steps of: (a) sensing intake air temperature in the vicinity of said fuel injection valves; and (b) setting a rate at which said fuel increment is decreased, to a value corresponding to the sensed intake air temperature.

2. A method as claimed in claim 1, wherein said step (a) comprises sensing said intake air temperature immediately after the start of said engine.

3. A method as claimed in claim 1, wherein, when the sensed intake air temperature is higher than a predetermined value corresponding to the boiling point of fuel, the rate of decrease of said fuel increment is set to a smaller value than that of which it is set when the sensed temperature is lower than said predetermined value.

4. A method as claimed in claim 3, wherein the initial value of said fuel increment is set upon generation of a predetermined control signal representative of predetermined crank angles of said engine immediately after cranking of said engine, the set initial value of said fuel increment being subsequently decreased by a predetermined amount each time a first predetermined number of pulses of said control signal are generated when the sensed intake air temperature is lower than said predetermined value corresponding to the boiling point of the fuel, and while the set initial value of said fuel increment being subsequently decreased by said predetermined amount each time a second predetermined number of pulses of said control signal are generated when the sensed intake air temperature is equal to or higher than said predetermined value, said second predetermined number being greater than said first predetermined number.

5. A method as claimed in claim 4, wherein when said fuel increment is greater than a predetermined reference value, said predetermined amount is set to a first value, and when said fuel increment is equal to or smaller than said predetermined reference value, said predetermined amount is set to a second value smaller than said first value.

6. A method as claimed in claim 5, wherein said predetermined reference value is set to a value based on the set initial value of said fuel increment.

7. A method as claimed in claim 1, wherein a basic value of the quantity of fuel being supplied to said engine is multiplied by said fuel increment to obtain said set quantity of fuel to be supplied to said engine.

* * * * *

UNITED STATES PATENT AND TRADEMARK OFFICE

CERTIFICATE OF CORRECTION

PATENT NO. : 4,765,301

DATED : August 23, 1988

INVENTOR(S) : Koike et al.

It is certified that error appears in the above-identified patent and that said Letters Patent is hereby corrected as shown below:

Column 10, line 54 before "which" change "of" to --to--.

Signed and Sealed this

Twenty-ninth Day of October, 1991

*Attest:*

HARRY F. MANBECK, JR.

*Attesting Officer*

*Commissioner of Patents and Trademarks*